US005880466A

United States Patent [19]

Benner

[11] Patent Number: 5,880,466

[45] Date of Patent: Mar. 9, 1999

[54] GATED CHARGED-PARTICLE TRAP

[75] Inventor: W. Henry Benner, Danville, Calif.

[73] Assignee: The Regents of the University of California, Oakland, Calif.

[21] Appl. No.: 869,282

[22] Filed: Jun. 2, 1997

[51] Int. Cl.[6] ..... H01J 49/00

[52] U.S. Cl. ..... 250/281; 250/282; 250/283; 250/397

[58] Field of Search ..... 250/281, 282, 250/283, 286, 287, 292, 291, 397

[56] References Cited

U.S. PATENT DOCUMENTS 5,753,909 5/1998 Park et al. ..... 250/287

*Primary Examiner*—Kiet T. Nguyen

*Attorney, Agent, or Firm*—Paul R. Martin; Henry P. Sartorio; David J. Aston

[57] ABSTRACT

The design and operation of a new type of charged-particle trap provides simultaneous measurements of mass, charge, and velocity of large electrospray ions. The trap consists of a detector tube mounted between two sets of center-bored trapping plates. Voltages applied to the trapping plates define symmetrically-opposing potential valleys which guide axially-injected ions to cycle back and forth through the charge-detection tube. A low noise charge-sensitive amplifier, connected to the tube, reproduces the image charge of individual ions as they pass through the detector tube. Ion mass is calculated from measurement of ion charge and velocity following each passage through the detector.

19 Claims, 4 Drawing Sheets

GATED CHARGED-PARTICLE TRAP

This invention was made with U. S. Government support under Contract No. DE-AC03-76SF00098 between the U.S. Department of Energy and the University of California for the operation of Lawrence Berkeley Laboratory. The U.S. Government may have certain rights in this invention.

I. BACKGROUND OF THE INVENTION

1. Field of the Invention

This invention relates generally to the field of charged particle trapping and more specifically to the use of a charged-particle trap to repetitively measure charged particles for mass spectrometry.

2. Description of Related Art

Electrospray ion sources are capable of generating high molecular weight (>1 MDa) multiply-charged ions. Measuring the mass of megadalton ions is possible using one of two mass spectrometry techniques. The first relies on Fourier Transform Ion Cyclotron Resonance ("FTICR") and the second utilizes the simultaneous measurement of charge and time of flight.

In the FTICR method ions are ejected into a trapping cell where the resonance condition defined by the magnetic and radio frequency fields definitively resolve the mass to charge ratio ("m/z") of the trapped ions. It is possible to determine the mass of the trapped ions by analyzing their various m/z states. The high resolution achieved with FTICR suggests that the numerous m/z states for electrospray ions exceeding 1 MDa should be resolved (J. E. Bruce et al., *Trapping, Detection, and Mass Measurement of Individual Ions in a Fourier Transform Ion Cyclotron Mass Spectrometer, J. Am. Chem. Soc.,* 116:7839, 1994). In practice, this goal had been confounded by heterogeneity of the population of trapped ions. An FTICR technique has been developed for analyzing individual electrospray ions thus avoiding the problem of heterogeneity. (X. Cheng et al., *Charge-State Shifting of Individual Multiply-Charged Ions of Bovine Albumin Dimer and Molecular Weight Determination Using An Individual-Ion Approach, Anal. Chem.* 66:2084, 1994). Currently however FTICR techniques are not well suited for rapidly analyzing a large number of individual ions sequentially, as is required for determining the average mass of a population of megadalton ions in a sample. FTICR techniques are also very expensive, requiring the use of large, complex instrumentation, including heavy magnets and ultra-high vacuum technology capable of achieving operating pressures of $10^{-11}$ to $10^{-12}$ Torr.

The second technique for megadalton ion mass spectrometry is described by Fuerstenau et al. in copending patent application Ser. No. 08/749,837, now U.S. Pat. No. 5,770,857. A low noise charge sensitive amplifier is used to capture the image charge of an ion accelerated through a known voltage V as it passes through a metal detector tube. The image charge signal comprises a pulse which rises when the ion enters the tube and falls when the ion exists the tube. The ion time of flight is measured from the pulse rise and fall, from which the ion's velocity is calculated. The mass to charge ratio of the ion, m/z, is calculated from the particle's time of flight when accelerated through a known electrostatic field. Simultaneously, the charge z of the ion is determined from the amplitude of the differentiated image charge signal, which is proportional to the ion's charge. With z known, the mass is calculated by multiplying the m/z and z.

The inventive mass spectrometer disclosed in copending patent application Ser. No. 08/749,837 measured ions making a single pass through a tube detector. Several thousand ions were analyzed in a few minutes, thus supplying enough data for calculating statistically significant measurements of the mass of molecules in a sample population. The cost advantage of this technology, when compared to FTICR, was obvious because large magnets and ultra-high vacuum were not needed. These two advantages were balanced, however, by the low precision of the single-pass charge detection approach. Depending on amplifier noise and the magnitude of the image charge, error in both the amplitude and timing measurements lead to fairly accurate but imprecise mass values.

In the one-pass format, the dominant cause of low mass resolution observed for megadalton DNA is due to imprecision of the charge measurement. An estimate of the relative errors associated with charge and velocity measurements can be determined using an electronic pulser to generate charge signals that simulate DNA ions flying through the detector tube. The use of a pulser eliminates measurement variations caused by fluctuations of ion charge and velocity. By introducing 10 $\mu$s wide 0.5 mV pulses into the charge-sensitive preamplifier, as typically produced by transiting 3 MDa ions formed by positive mode electrospray, the relative standard deviation (n=100) of the charge measurement is 0.054 compared to a relative standard deviation of 0.013 for the velocity measurement. These values illustrate the relative importance of the charge determination in limiting the precision of the overall measurement.

Time of flight ("TOF") mass spectrometers are instruments that measure the mass of ions by measuring the time they take to traverse a fixed distance. Typically these spectrometers have a source region where ions are formed and accelerated through a potential, a field free drift region, and a detector at the end of the drift region. A problem arises if the ions do not all have the same energy. Higher energy ions arrive at the detector ahead of lower energy ions having the same mass. This spreading of flight times limits the mass resolution of the spectrometer.

B. A. Mamyrin et al. described a time focusing ion mirror, which they term a "reflectron". Their ion mirror defocuses the ion beam in order to preserve the time resolution necessary for time-of-flight (TOF) spectroscopy (Soviet Physics JETP, 37(1973)4S). The Mamyrin reflectron comprises of a series of metal rings to which separate voltages are applied to establish an electrostatic field capable of reflecting incident ions about an axis of symmetry and in a plane normal to the plane of the mirror. The voltages applied to the metal rings that make up the reflectron create a flat electrostatic field between the rings. The reflectron causes ions having different energies but the same mass to arrive at the detector at the same time. Reflectrons are not used for spatial focusing, rather they depend on spatial defocusing to preserve the time resolution.

II. SUMMARY OF THE INVENTION

The present invention discloses a novel charged-particle trap used to determine the mass and charge of individual megadalton ions or charged particles. The present invention uses a sensitive low-noise charge sensitive amplifier to capture the image charge as charged particles pass through a metal detector tube. The transient image-charge signal consists of a pulse with an approximate square-wave shape whose rise and fall corresponds to ion entry and exit times in the tube. By timing the flight of charged particles with known energy, the particle's mass to charge ratio, m/z, is determined. The amplitude of the resulting differentiated charge pulse is proportional to the particle charge. Particle mass is calculated by multiplying m/z and z. It is an object of this invention to reflect a charged particle back and forth approximately along a single axis, providing the opportunity to make repeated measurements of a single charged particle. Reflection and radial focusing of ions is accomplished by establishing a potential well along the centerline axis of the charged-particle trap. The potential well is established using two charged-particle mirrors, each comprising a lens stack, located at each of two ends of a detector tube.

A charged-particle trap controller controls the voltages applied to the lenses of the entrance lens stack so that the field established by it may be turned on and off. A charged particle may be injected into the trap through a channel in the entrance lens stack when the field is turned off. A charged-particle detector, located between the entrance and second lens stacks, provides an input signal to the charged-particle trap controller when a charged particle enters the trap. In response to this signal, the charged-particle trap controller applies trapping voltages to the lenses of the entrance lens stack. When trapping voltages are applied to both lens stacks a charged particle residing between the lens stacks is trapped. Many individual measurements of the charged particle's TOF and charge are then made as it repeatedly transverses the charged-particle trap.

In one embodiment of the present invention, a detector system is used that has, at best, an RMS noise of 50 electrons. This is equivalent to a peak-to-peak noise signal of ±130 electrons. An amplifier operating at this noise level can readily distinguish ions carrying at least 250 charges from baseline noise. Signals from ions with less charge can also be detected but transients in the background signal interfere with timing and charge measurements. A mass spectrometer made using this detector and the inventive charged-particle trap routinely detects and mass analyzes DNA ions between 1.5 and 8 MDa, corresponding to an ion charge between about 600 and about 3200, respectively. Primary advantages of the present invention include the rate at which highly charged individual ions can be analyzed and the measurement precision gained from measuring the properties of the charged particle numerous times as it recirculates through the trap.

The inventive charged-particle trap comprises, a) an entrance mirror having a channel through which a charged particle travels; b) an exit mirror having a channel aligned with the entrance mirror channel; c) a charge detector tube located between the mirrors and having its long centerline axis aligned with the mirror channels, said tube being capable of having an image charge induced in it; d) an image charge detector connected to the detector tube; and e) an entrance voltage controller electrically connected to the entrance mirror and the image charge detector amplification and logic circuitry.

An inventive mass spectrometer made with the present charged-particle trap further comprises, an image charge calibrator, electrically connected to the image charge detector; and an image charge timer, electrically connected to the image charge detector.

III. SUMMARY DESCRIPTION OF THE DRAWINGS

Figure 3:
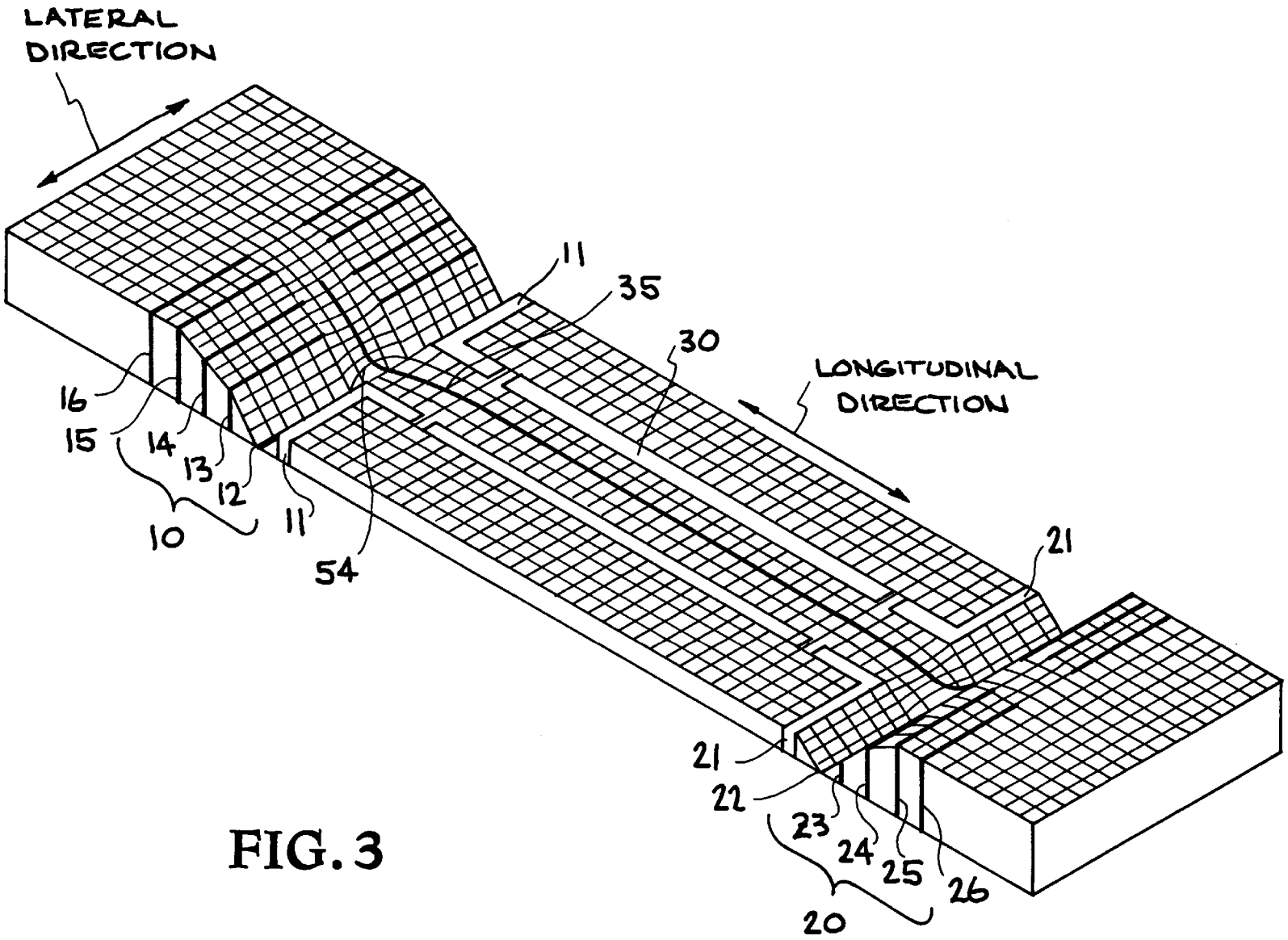

FIG. 3 presents a three dimensional view of an electrostatic potential of the charged-particle trap of Example 1.

Figure 4:
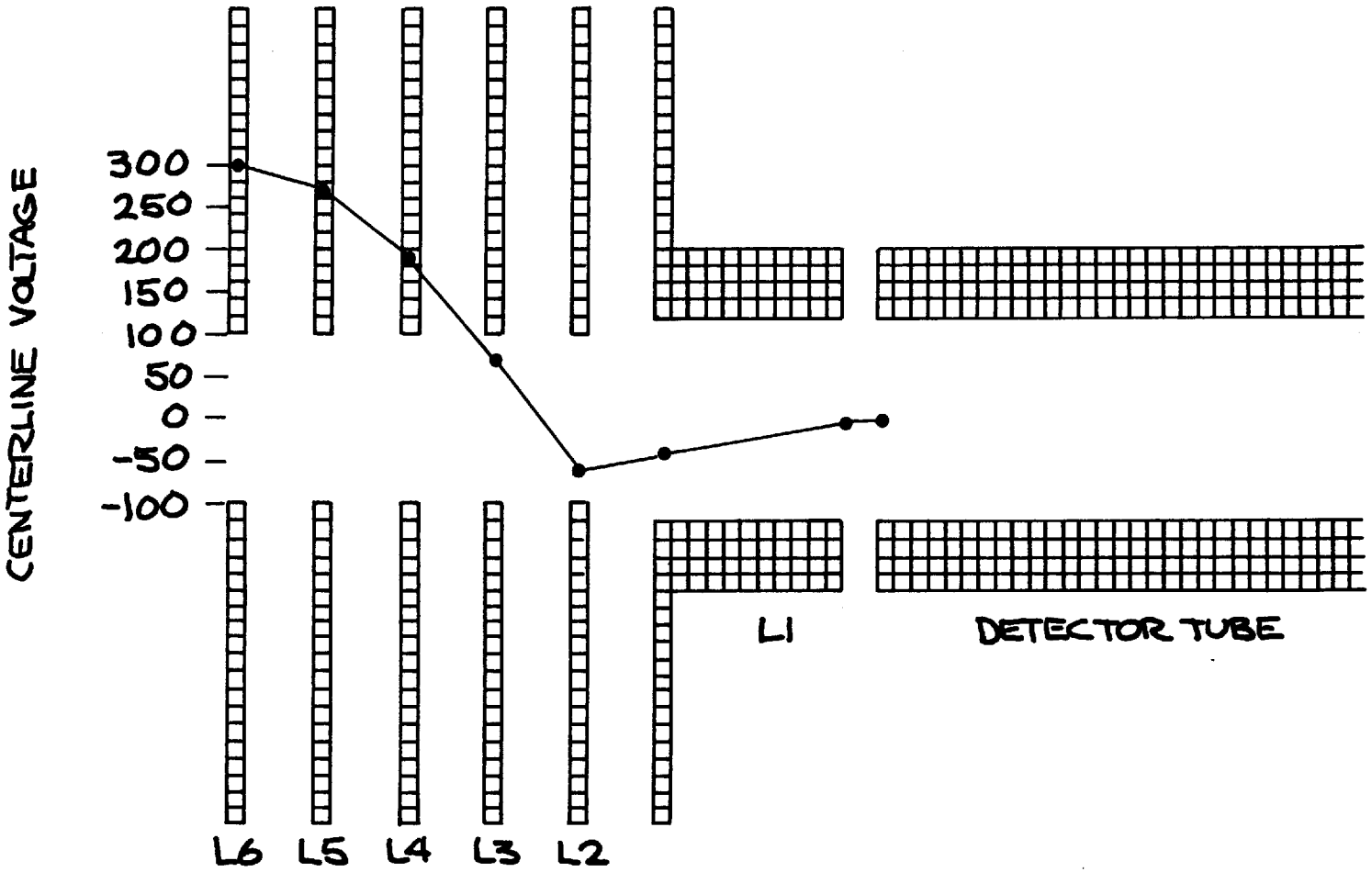

FIG. 4 shows a Simion software representation of mirror lenses. Juxtaposed is a plot of the potential along the center of the bore of the trap. As a positive ion travels from right to left, it travels at ground potential in the detector tube and accelerates until it passes L2, then decelerates in the rising positive field. These conditions trap ions possessing about 200 eV/charge.

Figure 5:
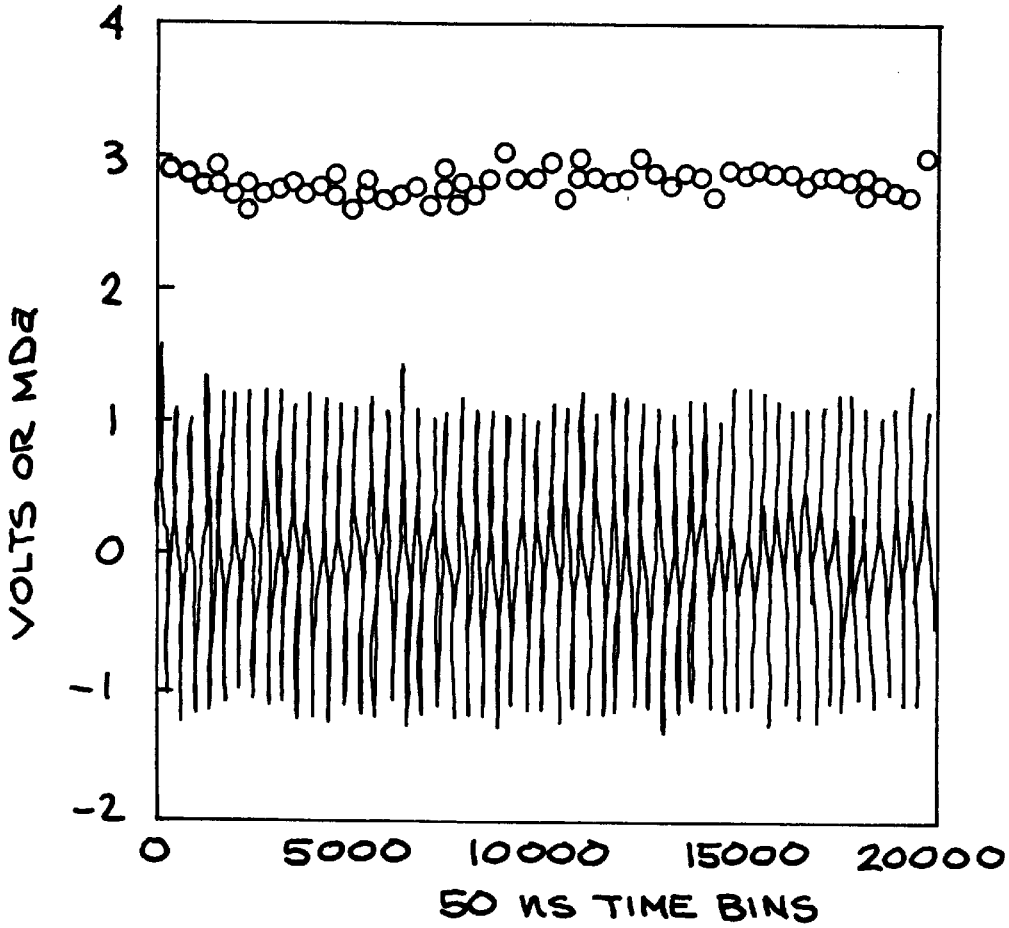

FIG. 5 The lower oscillatory waveform describes the cycling of a 2.88 MDa DNA ion in the inventive charged-particle trap. For this waveform, the vertical scale is volts and the displayed trapping time is 1 ms. Pulse height provides a measure of ion charge and the time between a positive peak and the ensuing negative peak is the time the ion is in the detector tube. Ion mass was calculated each time the ion traveled through detector tube and is plotted with open circles. The vertical scale for the mass data is MDa.

IV. DETAILED DESCRIPTION OF THE INVENTION

As used herein, "entrance mirror" means the first stack of electric field lenses a charged particle encounters as it enters the inventive charged-particle trap.

As used herein, "exit mirror" means the second stack of electric field lenses a charged particle encounters, located at the end opposite from the entrance end of the trap, where the particle is internally reflected back towards the entrance mirror.

As used herein, "trapping voltage" means a set of voltages applied to the entrance and exit mirrors lenses such that a charged particle traveling along a path between the two mirrors will be reflected approximately 180° on its path.

There are a limited number of options for improving charge measurement precision for the purpose of obtaining better mass measurements using a mass spectrometer. Reducing noise in the charge measurement circuit is difficult. With the current detector operating with a noise level of 50 electrons RMS further reduction in the noise level is constrained by fundamental limitations in the charge sensitive circuitry.

An approach that bypasses this limitation and which provides a more substantial improvement in the precision and accuracy of the charge measurement is to remeasure the charge on individual charged particles. Assuming that the source of the electronic noise is uncorrelated with the signal, each additional measurement of particle charge reduces the noise associated with the measurement by a multiplication factor of 1/sqrt(n), where n is the number of measurements that are averaged.

Figure 1:
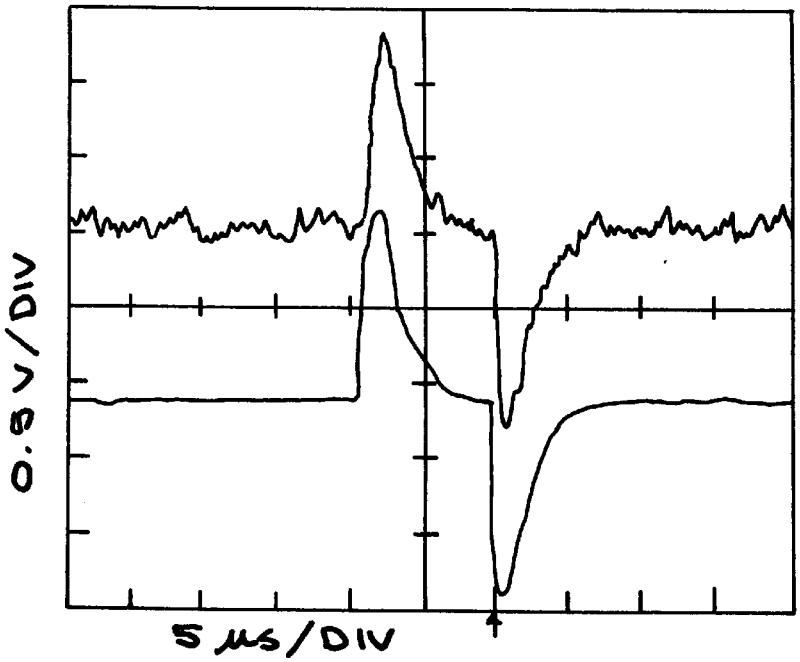
FIG. 1 shows two waveforms generated with a pulser which simulates an ion passing through the detector tube, showing decrease in noise when 100 times more measurements of the pulse are made.

The efficacy of signal averaging is shown in FIG. 1. The vertical scale is 0.5 V/div and the horizontal time scale is 5 μs/div. The upper trace corresponds to a single ion passing once through the detector tube and displays amplifier noise of 50 electrons RMS. The lower trace results when 100 of these waveforms are summed and averaged. Averaging decreases signal noise to 5 electrons RMS thus improving signal-to-noise by 10-fold and demonstrates the improvement that is gained when the charge on an ion is measured repeatedly.

Several approaches might be used to remeasure the charge on an ion repetitively to benefit from signal averaging. A linear series of detectors would accomplish this goal but for this approach each detector requires its own amplifier and a series of 100 detector tubes is impractical if a ten-fold reduction in noise is targeted. With much more simple instrumentation, a mass spectrometer using the inventive charge-particle trap measures the mass and charge of individual megadalton charged particles. The present invention uses a sensitive low-noise charge sensitive amplifier to capture the image charge as charged particles pass through a metal detector tube. The transient image-charge signal consists of a pulse with an approximate square-wave shape whose rise and fall corresponds to charged particle entry and exit times in the tube. By timing the flight of charged particles with known energy, particle m/z is determined. The amplitude of the resulting differentiated charge pulse is proportional to particle charge and mass and is calculated simply by multiplying m/z and z.

The present invention comprises a gated charged-particle trap that reflects charged particles back and forth within the detector tube so that charge and charged-particle velocity can be measured repetitiously, providing the opportunity for signal averaging.

Figure 2:
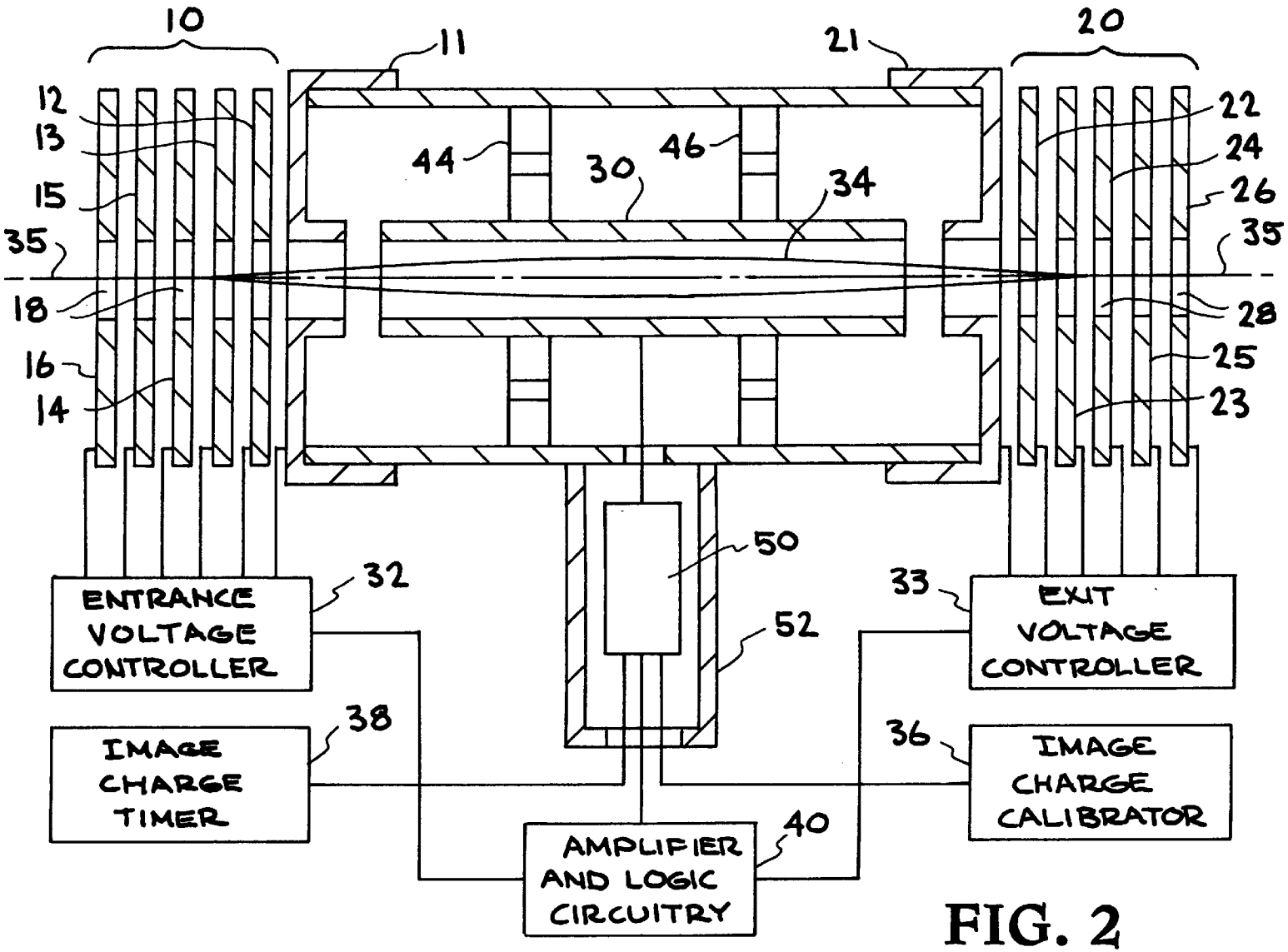
FIG. 2 is a schematic diagram of the gated charged-particle trap.

The charged-particle trap, shown diagramatically in FIG. 2, contains a charge-sensing detector tube 30, that is positioned between two charged particle mirrors, 10 and 20, each comprising a stack of electronic lenses. An entrance mirror comprises lenses 11,12,13,14,15, and 16, where, in this embodiment lens 11 is also a slideably mounted end cap for the detector tube. A second, or exit mirror comprises lenses 21, 22, 23, 24, 25, and 26, where, in this embodiment lens 21 is also a slideably mounted end cap for the detector tube. The lenses create a potential field in which velocity is reversed and the charged particles are guided to pass through the detector tube many times. The stretched ellipse 34, drawn inside the trap, roughly represents the path of an oscillating particle. The charged particle mirror reflects ions or other charged particles out of a potential well, reversing the average flight path direction by about 180°. The mirrors also provide a symmetric restoring force that focuses charged particles radially into the center line 35 of the detector tube causing them to pass repetitiously through the detector tube.

A switched electric field gate on the entrance mirror is key to operation of the charged-particle trap. Operation of this gated trap proceeds as follows: 1) Initially all potentials applied to the entrance mirror 10 on the entrance side of the detector tube are maintained at ground while the potentials on the exit mirror 20 are set to predetermined values designed to reflect and focus charged particles of a selected energy towards the detector tube. 2) A charged-particle source directs particles through the entrance lens stack into the detector tube. A detectable charge pulse from a charged particle (or a cluster of charged particles too close to one another to be spatially resolved) is detected to form a signal which triggers a voltage controller, 32, and optionally controller 33, and applies trapping potentials to the entrance mirror 10 lens stack and optionally to the exit mirror 20 lens stack. These potentials are established in a time interval less than is required for the particle to return after reflection from mirror 20. 3) Trapping potential are maintained during the time the particle remains trapped. The trapping potentials on each mirror are either held constant for the duration of the trapping event, or, the potential is changed from one set of trapping voltages to another in order to modulate the oscillation speed of the particle within the trap. After a trapped particle has been ejected through the exit mirror or lost for other reasons, perhaps through collision with the wall of the tube, the entrance mirror lenses are returned to 0 volts. The trap is then ready to receive another charged particle. 4) As charged particles pass back and forth through the pulse detector tube, the amplified and differentiated image charge pulses are recorded by a charge detector, 50, for the duration of the trapping time. The resulting waveform consists of wavelets corresponding to single passes of a particle through the detector tube. A statistically better charge measurement is achieved when the wavelets are parsed and averaged than is obtained from a single-pass measurement obtained using the mass spectrometer disclosed in copending patent application Ser. No. 08/749,837. Fourier transformation of the waveform is also useable to extract amplitude and frequency information from the waveform.

The detector tube, 30, is held axially in the bore of a metal block by two insulating disks, 44 and 46. The metal block provides electrical shielding. The insulating disks contain pump-through ports that allow the entire assembly to be evacuated efficiently. End caps on the block, designed with internal tubes which line up and face each end of the detector tube, provide additional electrical shielding at the ends of the detector tube. Two identical charged-particle mirrors are mounted adjacent to each endcap. In some cases the endcap itself comprises one of the mirror lenses. Counting outward from the center of the detector tube, the endcap is optionally used as a first lens, 11 and 21, in each mirror. Stainless steel plates, or other electrically conducting materials, separated with insulating spacers comprise the additional lenses. Centering holes were drilled in all of the lens plates and small tabs on the edge of each plate provide locations for attaching power supply wires. The holes comprise a charged-particle channel, 18 and 28, through the lens plates. A larger tube 52 was attached perpendicularly to one of the longer sides of the metal block and serves as a pedestal for attaching the detector assembly (detector tube, trapping electrodes and the shielding block) to a vacuum flange (not shown). Wires leading from electrical feed-throughs in the vacuum flange to the lens stack wrap around the outside of this support tube. A field-effect transistor (FET), along with its feedback resistor and capacitor, comprise an image charge detector, 50, located inside this supporting tube near the metal block. Wires leading to the FET were stretched inside the support tube. Image charge detector 50 is connected to amplifier and logic circuitry 40 which is located outside tube 52. The mounting structure design was optimized both to minimize stray capacitance associated with the detector tube and the wire connecting the detector tube to the FET. The mounting structure was optimized to minimize microphonic contributions to the background signal.

The charged-particle trap is enclosed in a vacuum chamber (not shown) and vacuum pumps and other equipment (not shown) are utilized to achieve an operating pressure of between about $10^{-6}$ and about $10^{-8}$ Torr. Use of ultrahigh vacuum apparatus is not needed. After a vacuum has been established around the trap, charged particles are generated by a charged particle source (not shown) and accelerated through a known voltage V towards the entrance mirror.

The lenses in each charged-particle mirror are aligned so that their channels are centered about a reflecting axis. The entrance and exit mirrors are positioned so that their reflecting axes coincide, defining the centerline 35 of the charged-particle trap.

When the non-trapping voltages are applied, a charged particle will be able to pass through the mirror, either to enter or to exit the trap through the mirror channel. It is convenient to set the non-trapping voltages all to 0 V, but any set of voltages that create a field with a maximum potential less than the particle's accelerating voltage V is a non-trapping set of voltages.

When the charged particle passes through the entrance mirror and enters the detector tube, an image charge is induced in the detector tube. The signal from the image charge is picked up by the image charge detector, 50, located in close proximity to the detector tube in a shielded arm, 52. Having detected the entrance of a charged particle, a signal from the image charge detector passes through amplifier and logic circuitry 40 and activates the entrance voltage controller, 32, to apply trapping voltages to the entrance mirror lenses before the charged particle returns from its reflection off the exit mirror. The entrance voltage controller is, in effect, an electronic gate. The voltages on the exit mirror lenses remain continually at trapping voltage settings. Alternatively, after a chosen number of measurements are made on a particle, the voltages on the exit mirror lenses are changed to allow the particle to exit the trap. At that point, the particle is directed into a collection container. The exit mirror voltages are controlled by the entrance voltage controller or in some cases by a second controller dedicated to the exit mirror, an exit voltage controller, 33.

Initially, non-trapping voltages are applied to the entrance mirror lenses. Trapping voltages are applied to the lenses of the exit mirror throughout the operation of the charged-particle trap. A charged particle enters the trap through the entrance mirror channel along the centerline of the trap. It's induced image is then detected by an image charge detector.

When trapping voltages are applied to the lenses, a field capable of reflecting an incident charged particle is established. In addition, trapping voltages prevent new charged particles from entering the trap while a trapped particle resides inside the trap. The entrance and exit mirrors are essentially either in trapping state or in a non-trapping state depending on the voltage applied to the mirror lenses. When the trapping voltages are applied to the lenses, a charged particle traveling into the lens stack along its reflecting axis is reflected back along the reflecting axis in the opposite direction. The charged particle decelerates as it travels into the lens stack channel, climbing an electronic potential well presented by the lens stack. When the initial ratio of charged particle energy to charge equals the magnitude of the local potential, the charged particle stops and reverses its direction of motion, accelerating back down the potential well. The charged particle actually penetrates the mirror's lens stack before the mirror causes the charged particle to change its path direction by about 180°.

The voltages applied to the lenses of the entrance mirror, 10, are controlled by the entrance voltage controller, 32. The controller can apply either trapping or non-trapping voltages to the entrance mirror lenses. The voltages applied to the lenses of the exit mirror, 20, are controlled by the exit voltage controller, 33. The controller can apply either trapping or non-trapping voltages to the exit mirror lenses.

The present invention uses a preamp FET to detect the charged particle. Other ways of detecting the charged particle include the detection of light scattered by the charged particle, fluorescent light emitted by the particle, and the detection of magnetic field perturbations caused by the moving charged particle.

When a charged particle is detected entering the trap, trapping voltages are applied to the lenses of the entrance and exit mirror. The charged particle travels along the centerline of the trap towards the exit mirror and is subsequently reflected back towards the entrance mirror by the exit mirror. Because trapping voltages are now applied to the entrance mirror, the charged particle is reflected again back towards the exit mirror. The charged particle repeatedly traverses the trap as it is reflected back and forth between the mirrors along the trap centerline.

Each time the charged particle traverses the trap its properties are measured. Eventually, the charged particle will collide with the detector wall, and the measurement will end. The charged-particle trap controller will then apply non-trapping voltages to the entrance lenses, so that another charged particle may enter the trap.

Alternatively, a second voltage controller 33, also controls the voltages applied to the lenses of the exit mirror so that selected particles can be ejected from the trap.

The switching speed of the lens voltage controller has to apply or remove voltages rapidly. After an entering charged particle is detected, voltages have to be applied to the entrance mirror lenses before the particle re-enters the entrance mirror, having been reflected out of the exit mirror. The switching time was approximately 10 $\mu$sec for the ion recorded in FIG. 5. The switching time is mandated by particle energy and m/Z. For the ion in FIG. 5, a faster switching time is required when ion energy is increased.

In addition to reflecting charged particles along the centerline of the trap, the fields established by the lens stacks radially focus the particles towards the trap centerline. Radial focusing is necessary to compensate for small deviations in the charged particle's trajectory which might prevent the charged particle from following a path near the centerline of the trap. Without this compensation, or focusing, the charged particle would collide with the trap after only a few traversals. A charged particle moving away from the centerline trajectory as it travels into and out of a lens stack will experience a radial restoring force created by the voltages on the mirror lenses, which keeps the particle from deviating further from the centerline. The result is that the charged particle trajectory is confined to a volume of space around the centerline.

FIG. 3 shows a three dimensional view, produced with Simion 6.0, of the potential valley created to trap positively charged particles. The thick black lines show the location of the electrodes and detector tube. The vertical axis of this plot is voltage. The detector tube and lenses 11 and 21 are at ground potential; lenses 12 and 22 are at −100 V; lenses 13 and 23 are at 100 V; lenses 14 and 24 are at 200 V; lenses 15 and 25 are at 300 V, as are lenses 16 and 26. The line drawn through the center of the detector tube and extending part of the way up the potential valley, 35, shows the path followed by trapped particles.

The electric field illustrated in FIG. 3 was used to trap ions initially accelerated through an accelerating potential of between 215 to 230 V. Measuring outward from the center of the detector tube, the distance into either mirror from either mirror's first lens, 11 and 21, is measured along the Z axis. The radial distance away from the centerline in the plane of the lens is measured along r. The potential generally increases as either z or r increases. Optionally, the potential presented by each mirror can initially decrease with z, before increasing, in order to create an appropriately shaped field between the lens stacks. FIG. 3 depicts the potential decreasing from the innermost lenses, 11 and 21 to the next lens, 12 and 22, in each stack. As shown in the figure this results in a saddle point 54 between the first and second lenses.

Both the reflecting and radial focusing characteristics of the field are determined by the trapping voltages that are applied to the mirror lenses. It is not possible to achieve all desired reflecting and focusing characteristics. Rather, the radial gradient in the field is a result of the fringing fields created by the lens channels. The radial gradient depends on the manner in which the potential increases along z, on the spacing between lenses within a mirror, and on the size of the channel in the lenses. In general, a non-linear increase in the potential along z creates the greatest radial focusing gradients.

An ion optics simulation program, Simion 6.0, available from Idaho National Engineering Laboratory, is used to determine a set of trapping voltages which effectively trap a charged particle which has been accelerated through a voltage V. The mirrors' lens stack geometry is programmed into the simulation, and voltages can be applied to each lens. A charged particle having a particular mass and charge, is then simulated to fly into the trap where its trajectory is governed by the simulated field. The voltages can be varied until a set is found which results in the charged particle being reflected back and forth numerous times in the simulated trap.

Careful adjustment of the voltages applied to the trapping plates is needed to produce trapping conditions when extended trapping times are desired. The mirror lenses, which can also be referred to as electrodes, were made from square metal plates with centered holes. In FIG. 3 they are drawn as if they were sliced in half horizontally and pulled apart to reveal the inside of the trap. FIG. 3 shows the electric potential grid as if a net was draped over the open trap. The shape of this net represents a potential surface; the height of the net indicates the magnitude of local electric potential. The potential grid, or net, is in the shape of a valley. Centerline 35 represents the floor of the valley. Within detector tube 30, the valley floor is relatively flat, both longitudinally and laterally (that is, side to side, across the diameter of the tube). Between the endcaps and the outer lenses the valley floor dips, then rises, and eventually levels. The valley sides turn downward at the dip, making a saddle at point 54, then sides slope upward as the valley floor climbs to the outermost lenses. The valley floor profile is shown in FIG. 4. When an ion enters the valley from the lower end of the valley, that is exiting the detector tube and entering a mirror, the ion glides along the valley floor and slows down as it climbs the potential represented by the rising valley floor. Eventually it will run out of energy and stop. Then it will turn around and glide back down the valley floor. The shape of this valley, both longitudinally and laterally, controls the path of the ion. The lateral shape, represented by the steepness of the sides of the valley, acts to restore the ion to an axial trajectory. The length of the valley floor and its upward slope determines how far the ion will travel into the trapping field and the rate the ion will decelerate. If the valley is shallow and does not rise very high, ions will glide out of the valley. In fact, controlling this parameter allows the user to filter the trap for charged particles having less than some particular energy.

The lateral and longitudinal shape and slope of the valley is controlled by the voltages applied to the mirror lens, the spacing between electrodes and the diameter of the channel in the electrodes. Many possible combinations of these parameters will produce a potential valley. The best trapping conditions are established by applying a set of voltages to the mirror lenses that cause the potential "net" to stretch axially away from the middle of the lenses. This is accomplished by lowering the voltage on L2 to a value less than the voltage on L1 or L3 and setting the voltage on L6 nearly equal to the voltage on L5. The relatively negative voltage on lens L2, causes the valley sides to slope upward in the more outer lenses and that upward slope is critical to keep the ion radially centered on path 35 as it slows and reverses direction. In FIG. 3, two lenses are placed between L5 and L2 but a different number of lenses will also produce a workable potential valley. For the lens arrangement shown in FIG. 3, preferred ion trapping conditions are established when a plot of the potential along the valley floor is flat within and at the end of the detector tube, decreases slightly in the end caps, then rises between L2 and L3 and starts to level out as L6 is approached. A plot of the potential along the valley floor is shown in FIG. 4. When working with computer modeling program, the trapping conditions are obtained by modeling the potential surface with, for example Simion software, and estimating different electrode geometries and voltages. Lens channel size, number, spacing, and voltages can be adjusted and tuned to provide needed trapping conditions for a given particle energy. The conditions that generate preferred trapping times with the model can then be transferred to the operation of the trap. Alternatively, the best starting conditions are established by physical trial and error, comprising adjustment of the voltages on the mirror lenses.

Once the initial voltages are set, a charged particle is introduced into the trap essentially along a line near the centerline of the trap. The angle between the particle path and centerline of the trap may diverge by a few degrees from the centerline of the trap, but is preferably within about 3°. More fundamental than the entry angle of the particle is how far the particle deviates from the centerline as it approaches either lens stack. The angle of the entry path must be small enough that the particle does not deviate farther from the centerline than about two-thirds of the radial distance between the centerline and lens bore radius. For example, if the lens bore has a 3 mm radius, the particle must remain within 2 mm of the center of the bore for long trapping times to result.

There are many lens stack configurations that can be used to establish a field that both reflects and radially focuses charged particles along the mirror reflecting axis. A commercially available charged particle optics simulation program, Simion 6.0, available from Idaho National Engineering Laboratory, was used to explore different lens stack configurations. The number of lenses in each stack can be as small as one and as large as space permits, although use of only one lens is likely to reflect only charged particles exactly on the centerline and use of more than six provides diminishing improvement of trapping efficiency. In general, the size of the trap can be linearly scaled to produce smaller and larger trapping volumes. Performance trade-offs can be evaluated by those skilled in the art and practicing this invention. For example, it may be desirable to decrease physical dimensions of the charged-particle trap. The advantages of small size will have to be weighed by the user against the disadvantage of a smaller entrance channel cross-section intersecting the path of fewer particles. Alternatively, for some applications it may be desirable to build larger traps, for example if a large entrance channel cross-section is desired. In that case, the user must weigh the advantage of trapping many more particles with the disadvantage associated with a trapping volume large enough to permit trapped particle to meander through the detector tube, thus degrading the image signal.

The lenses are constructed from electrically conducting materials. They are thick enough to retain shape. Using techniques readily apparent to those of skill in the field, lens size and shape are designed to limit the effect of fringing fields in the trap.

The channel diameters through the lenses can also vary. The channels need not extend radially more than the volume about the centerline in which the particles are required to be confined within the charged-particle trap.

EXAMPLE 1

Gated Charged-particle Trap

FIG. 2 shows the inventive ion trap built around a charge sensitive detection tube 30. The detector tube (37.5 mm×6.5 mm id.), is held axially in the bore of a metal block (3 cm diameter, 5 cm long) by two polyethylene disks. The metal block provides electrical shielding. The polyethylene disks contain pump-through ports that allow the entire assembly to be evacuated efficiently. End caps on the block, designed with internal tubes which line up and face each end of the detector tube, provide additional shielding at the ends of the detector tube. Two identical lens stacks are mounted on each end cap. Five square (5 cm×5 cm, 0.05 cm thick) stainless steel plates separated with insulating spacers (0.2 cm long) comprise the lens stack on each end cap. Centering holes (0.5 cm diam.) were drilled in all of the lens plates and small tabs on the edge of each plate provide locations for attaching power supply wires. A larger tube (4 cm diam, 15 cm long) was attached perpendicularly to one of the longer sides of the metal block and serves as a pedestal for attaching the detector assembly (detector tube, trapping electrodes and the shielding block) to a 6" diameter vacuum flange. Wires leading from electrical feedthroughs in the vacuum flange to the lens stack wrap around the outside of this support tube. A field-effect transistor (FET), along with its feedback resistor and capacitor, is located inside this supporting tube near the metal block. Wires leading to the FET were stretched inside the support tube. The mounting structure design was optimized both to minimize stray capacitance associated with the detector tube and the wire connecting the detector tube to the FET. The mounting structure was optimized to minimize microphonic contributions to the background signal.

The ion optics simulation program, Simion 6.0 (Dahl, D., Simion 3D, Version 6.0, Idaho National Engineering Laboratory) was used to study 3D potential gradients that produce ion trapping potential fields. Many different lens geometries were examined as possible trapping fields and those that performed best looked like a valley with a rising valley floor. FIG. 3 shows a typical 3D potential gradient that efficiently traps ions. The potential gradient in FIG. 3 was produced with two sets of five lenses plus uses of an end cap as one lens. Each lens in this model contains a centering channel through which ions travel. The distance an ion travels in the trapping field, in other words the number of plates through which it penetrates before it turns around, is determined by the relative height of the potential valley with respect to the energy/charge ratio of the ion. For the potentials in FIG. 4, an ion carrying 180 eV/charge would be reflected at L4. In other words, such an ion traveling in the L1 to L4 direction in FIG. 4 would not travel farther than L4. For the potential valley in FIG. 3, only ions in a defined range of energy are trapped. Higher energy ions or charged residue particles fly out of the valley and are not captured. Less energetic ions are not trapped because they roll off the potential saddle between lens L1 and lens L2. The lens numbering system progresses from L1, the end cap, to L6, the plate farthest from the end cap. For each mirror, L1 refers to the end cap; L2 refers to lenses 12 and 22; L3 refers to lenses 13 and 23; L4 refers to lenses 14 and 24; L5 refers to lenses 15 and 25; and L6 refers to lenses 16 and 26. The potential valley depicted in FIG. 3 results when the following voltages are applied to the plates in a lens stack: L1=0, L2=−100, L3=100, L4=200, L5=300, L6=300. L3 to L5 define a nearly linear gradient. Setting L6=L5 and applying a negative potential on L2 creates the rising potential valley and the negative potential on L2 additionally prevents the potential gradient from extending into the detector tube.

The endcaps were located immediately adjacent to and in contact with to the ends of the shielding tube. The endcaps could be slided along the shielding tube so that the gap between the endcaps and the detection tube could be adjusted. The gap width affects the rise and fall time of the signal induced on the charge sensitive detection tube.

The slope of the potential valley can be better comprehended by examining a plot of the potential along the centerline of the channel of the trapping plates as presented in FIG. 4 The centerline potential controls ion velocity. As an ion exits the detector tube it accelerates slightly until it passes through L2 and then rapidly decelerates as it climbs in the potential valley between L2 and L5. When the magnitude of ion's energy/charge ratio equals the magnitude of the local potential (for example, when an ion having 100 eV/charge reaches a lens having 100 V), the ion stops, turns around, and accelerates back down the potential valley. An identical potential valley awaits its arrival in the mirroring lens stack at the opposite end of the detector tube where the ion is forced to turn around again.

FIG. 5 shows the waveform created by a single highly charged electrospray ion of DNA, as it recirculated through the trap. The ion is a 4.3 kilobase long circular DNA molecule of a bacterial plasmid described as pBR322. The entire waveform composes wavelets corresponding to single passes of an ion through the detector tube. The time between a positive and the ensuing negative pulse represents the time the ion spent in the detector tube and the time between a negative pulse and the next positive pulse corresponds to the time it takes an ion to turn around in the trapping field. The shape of each wavelet is roughly the same because its shape does not depend on the direction an ion travels. The amplitude of these wavelets provides a measure of ion charge. This particular ion carried an average of 1040 charges and the 1 ms record shows that the ion recycled more than 51 times through the trap. The actual trapping time was longer than 1 ms but only 1 ms of data is presented. Amplitude and timing data for each cycle through the detector tube was used to calculate ion mass.

The ion detector was not only used to provide a signal to the ion trap controller, but was also used to measure the ion's charge and time of flight. From these measurements a mass calculation was possible. The open circles above the waveform indicate the mass values calculated from each cycle and these values fall between 2.59 and 3.02 MDa. When these 51 mass values are averaged, the mean±SD is 2.79±0.09 MDa and the 95% confidence interval of the measurement is 0.01 MDa. This value compares favorably to the expected mass of 2.88 MDa for pBR322 DNA in the sodium form. The difference between 2.79 and the expected value of 2.88 MDa appears to be due to cleanup procedures which removed some of the sodium ions from the sample and exchanged them with H+. When ions from this same sample were analyzed with the one-pass method, using the instrument described in copending patent application Ser. No. 08/749,837, an average value of 2.9 MDa was obtained when several thousand ions were analyzed.

The length of time an ion can be confined in this gated charged-particle trap determines the precision with which ion mass can be calculated. The time an ion is trapped depends on factors related to the trajectory the ion follows in the trap and detector tube. The most stable trajectory results when an ion follows a radially-centered path through the tube and turns around in the external trapping field without deviating from its centerline position. An ion following a centerline trajectory will remain confined in the trap until it is slowed by gas collisions or spontaneously fragments. An aperture located between the electrospray source and the entrance plates confines ions to ±1mm of the axis of the detector tube. A large fraction of the ions entering the detector tube are trapped. Ions that are more than 1 mm off the centerline or are not traveling parallel to the axis acquire a slightly different trajectory each time they turn around in the trapping field and eventually strike the electrodes or the tube. Gas collisions reduce the energy of the ions and contribute to unstable ion trajectories. The presence of a gas jet flowing through the trap, created by the electrospray source, might be significant. The background gas pressure surrounding the trap was in the $10^{-8}$ Torr range for this experiment.

The longest time an ion has been trapped so far is about 10 ms during which time an ion oscillated nearly 500 times through the detector tube. Trapping times as long as this suggest that charge measurements obtained from this repetitious measurement technique could be as precise as the RMS noise level of the detector (50 electrons RMS) divided by the sqrt 500 or ±2.2 electrons RMS. These results demonstrate a mass measurement precision surpassing gel-based analyses for large DNA ions.

It should be noted that the mass measurement technique described here is amenable to direct calibration since it depends only upon the detector tube length, pulse height of the image signal, and ion transit time. The relationship between signal amplitude and induced charge is determined by depositing a known voltage on a 0.215 pF test capacitor. Measurement of tube length is accurate to better than 1 part in 500, although we have preliminary data that indicates that the effective electric tube length is nearly 2 percent longer than the physical tube length. The electric tube length is the length value that is used to calculate ion velocity and it is different from the physical length because of the way the image charge is captured by the detector tube. Pulse amplitude and ion transit time measurements are determined with a self-calibrating digitizing oscilloscope and is accurate to within a fraction of a percent. As noted earlier the accuracy of the mass measurement is dominated by the charge-measurement accuracy. Now that ion charge can be measured with improved accuracy with the trapping technique, the relative inaccuracy of velocity and energy measurements will need to be reevaluated.

EXAMPLE 2

Trapping voltages for 120 to 140 V particle

The ion optics simulation program, Simion 6.0, was also used to calculate the trapping voltages for ions accelerated through a potential between 120 and 140 V. They were found to be 0 V applied to lenses 11 and 12; −100 V applied to lenses 12 and 22; 50 V applied to lenses 13 and 23; 130 V applied to lenses 14 and 24; and 200 V applied to both lens pairs 15 and 16, and 25 and 26.

EXAMPLE 3

Trapping voltages for 80 to 100 V particle

The ion optics simulation program, Simion 6.0, was used to calculate the following trapping voltages used to trap ions accelerated through a potential between 80 and 100 V: 0 V applied to lenses 11 and 12; −150 V applied to lenses 12 and 22; 20 V applied to lenses 13 and 23; 75 V applied to lenses 14 and 24; and 150 V applied to both lens pairs 15 and 16, and 25 and 26.

EXAMPLE 4

Calculation of ion mass using the ion trap as a mass spectrometer

One of the most important uses of the inventive charged-particle trap is its use in a mass spectrometer. Using the present invention in a mass spectrometer allows mass values of the particles to be determined with greater resolution than previously possible. In order to use the charged-particle trap in a mass spectrometry mode, an image charge calibrator 36 must be electrically connected to the image charge detector 50 and an image charge timer 38 must be electrically connected to the image charge detector 50. The image charge calibrator calibrates the magnitude of the image charge detected by the image charge detector; the image charge timer measures the key parameters of the image charge pulse shape.

An ion of known energy is introduced into the trap. When an entering ion is detected with the image charge detector, trapping voltages are applied to the entrance mirror thus trapping the ion and forcing it to recirculate through the detector tube. Each passage of the ion through the detector tube generates an image charge signal approximated by a square pulse. The width of the pulse corresponds to the time the ion resided in the detector tube and the magnitude of the pulse is proportional to the charge carried by the ion. Additional amplifiers are used to improve the accuracy of the time and image charge measurements. Ion velocity is calculated using the length of the detector tube and the transit time. The charge to mass ratio of the ion is calculated from $2V/v^2$, where V=the voltage used to accelerate the ion into the trap and v=ion velocity. Electronics that further calibrate the image charge signal provides an accurate way to determine the actual charge carried by the ion. This is performed by comparing the image charge signal to a signal produced with a known quantity of charge. Ion mass is then calculated by multiplying the mass/charge ratio by the measured charge. Measurements of ion mass, charge, mass/charge ratio and velocity are thus made possible by using the novel charged-particle trap in a mass spectrometer. The trapping technique provides a way to obtain statistically significant measurements of these parameters. These parameters can be calculated using the image charge signal generated each time an ion passes through the detector tube so that average values are obtained.

EXAMPLE 5

Determination of ion energy

An ion of known mass is introduced into the trap. When an entering ion is detected with the image charge detector, trapping voltages are applied to the entrance mirror thus trapping the ion and forcing the ion to recirculate through the detector tube. Each passage of the ion through the detector tube generates an image charge signal approximated by a square pulse. The width of the pulse corresponds to the time the ion resided in the detector tube and the magnitude of the pulse is proportional to the charge carried by the ion. Additional amplifiers are used to improve the accuracy of the time and image charge measurements. Ion velocity is calculated using the length of the detector tube and the transit time. Ion energy is calculated using $E=\pm mv^2$, where m=ion mass and v=ion velocity. An alternative approach for determining ion energy is to use a charge-calibrated detector and calculate V using $V=mv^2/2z$, where m=ion mass, v=ion velocity and z=ion charge.

EXAMPLE 6

Determination of the frequency of ion recirculation

An ion of known mass is introduced into the trap. When an entering ion is detected with the image charge detector, the entrance lens plates are switched on forcing the ion to recirculate through the detector tube. Each passage of the ion through the detector tube generates an image charge signal approximated by a square pulse. The width of the pulse corresponds to the time the ion resided in the detector tube and the magnitude of the pulse is proportional to the charge carried by the ion. Additional amplifiers might be used to improve the accuracy of the time. The next image charge signal generated by the recirculating ion appears after the ion turned around in one of the sets of trapping electrodes and reentered the detector tube. The time between the start of the first image pulse and the start of the second image pulse equals ± the time, $t_c$ it takes an ion to make a complete cycle through the trap. The oscillation frequency equals $\frac{1}{2}t_c$.

In summary, a gated charged-particle trap is described which provides repetitious charge and time-of-flight measurements of single charged particle. Particle charge was determined using an induced image picked up from a detector tube connected to the input of a sensitive low-noise charge-sensitive amplifier system. The magnitude of the image charge signal is proportional to ion charge. The rise and fall of the image signal provide a method for measuring ion velocity from which m/z is obtained. Ion mass is calculated for each ion simply by multiplying these two values. The operation of the trap has been demonstrated by trapping megadalton ions of DNA. The advantages of the inventive charged-particle trap are: 1) the charge and m/z of individual ions can be measured repeatedly, thus improving the accuracy of the mass calculation over that obtained with a previously described one-pass measurement technique; 2) a mass spectrometer made using the novel charged-particle trap measures mass for particles having a mass to charge ratio greater than 3000; and 3) a mass spectrometer made with the novel trap has greater resolving power than current mass spectrometer for particles having large m/z. The inventive charged particle trapping approach, combined with image charge detection, provides a way to determine the mass of megadalton charged particles, such as DNA, with much less expensive instrumentation than needed for FTICR. The technique provides a faster and accurate way to size large DNA molecules than is possible with gel electrophoresis.

The description of illustrative embodiments and best modes of the present invention is not intended to limit the scope of the invention. Various modifications, alternative constructions and equivalents may be employed without departing from the true spirit and scope of the appended claims.

Having thus described the invention, what is claimed is:

1. A charged-particle trap comprising:

a) an entrance mirror having a channel through which a charged particle travels;

b) an exit mirror having a channel aligned with the entrance mirror channel;

c) a charge detector tube located between the mirrors and having its long centerline axis aligned with the mirror channels;

d) an image charge detector connected to the detector tube; and e) an entrance voltage controller electrically connected to the entrance mirror and the image charge detector.

2. The trap of claim 1, wherein the entrance mirror comprises a plurality of lenses, each having a channel centered along a common axis.

3. The trap of claim 2, wherein the entrance mirror comprises between 3 and 10 lenses.

4. The trap of claim 2, wherein the entrance mirror comprises between 5 and 8 lenses having channels centered along a common axis.

5. The trap of claim 2 wherein one of the entrance mirror lenses forms a detector tube endcap.

6. The trap of claim 1 wherein a detector tube has two endcaps, one located on an entrance port of the tube and another located on an exit port of the tube, each endcap having a channel aligned with the mirror channels.

7. The trap of claim 1, wherein the exit mirror comprises a plurality of lenses having channels centered along a common axis.

8. The trap of claim 7, wherein the exit mirror comprises between 3 and 10 lenses.

9. The trap of claim 7, wherein the exit mirror comprises between 5 and 8 lenses.

10. The trap of claim 7, wherein one of the exit mirror lenses forms a detector tube endcap.

11. The trap of claim 1 further comprising an exit voltage controller electrically connected to the exit mirror and the image charge detector.

12. A mass spectrometer having a charged-particle trap comprising:

a) an entrance mirror having a channel through which a charged particle travels;

b) an exit mirror having a channel aligned with the entrance mirror channel;

c) a charge detector tube located between the mirrors and having its long centerline axis aligned with the mirror channels, on which an image charge is induced when a charged particle travels therethrough;

d) an image charge detector connected to the detector tube;

e) an entrance voltage controller electrically connected to the entrance mirror and the image charge detector;

f) an image charge calibrator, electrically connected to the image charge detector; and g) an image charge timer, electrically connected to the image charge detector.

13. A method for trapping a charged particle for several transits between two charged-particle mirrors comprising, a) applying an initial set of trapping voltages to an exit mirror;

b) applying a set of non-trapping voltages to an entrance mirror;

c) detecting a charged particle entering a detection tube located between the entrance and exit mirrors; and d) applying an initial set of trapping voltages to the entrance mirror before the charged particle is reflected back into the entrance mirror.

14. The method of claim 13 wherein the non-trapping voltages are zero.

15. The method of claim 13 further comprising the step of changing from the initial set of trapping voltages to a second set of trapping voltages after the particle is trapped.

16. A method for making repetitive charge magnitude measurements on a charged particle comprising the steps of:

a) applying an initial set of trapping voltages to an exit mirror;

b) applying a set of non-trapping voltages to an entrance mirror;

c) detecting a charged particle entering a detection tube located between the entrance and exit mirrors;

d) applying an initial set of trapping voltages to the entrance mirror before the charged particle is reflected back into the entrance mirror;

e) measuring the magnitude of an induced image charge from the particle; and f) calibrating the magnitude of the image charge with an absolute charge value.

17. A method for making repetitive velocity measurements on a charged particle comprising the steps of:

a) applying an initial set of trapping voltages to an exit mirror;

b) applying a set of non-trapping voltages to an entrance mirror;

c) detecting a charged particle entering a detection tube located between the entrance and exit mirrors;

d) applying an initial set of trapping voltages to the entrance mirror before the charged particle is reflected back into the entrance mirror; and e) measuring a time period between a rise and a fall in an image charge signal.

18. A method for making repetitive oscillation frequency measurements on a charged particle comprising the steps of:

a) applying an initial set of trapping voltages to an exit mirror;

b) applying a set of non-trapping voltages to an entrance mirror;

c) detecting a charged particle entering a detection tube located between the entrance and exit mirrors;

d) applying an initial set of trapping voltages to the entrance mirror before the charged particle is reflected back into the entrance mirror; and e) measuring a time period between onset of a first image charge signal from the particle and a next image charge signal from the particle.

19. A method for determining a set of trapping voltages comprising the steps of:

a) entering a set of key parameters into a computer modeling program, said key parameters comprising, energy in volts of charged particle to be trapped, number of lenses in each mirror, dimensions and thickness of lenses, dimensions of lens channel, distance between lenses, length and inner dimensions of a detector tube, shape of a detector tube endcap, voltage applied to detector tube, and voltages applied to each lens; and b) adjusting the key parameters until a model potential grid shows a "u" shaped valley in the channel of the mirror lenses farthest away from the detector tube and an inverted "u" shaped valley in mirror lenses immediately adjacent to the endcap.

* * * * *